United States Patent [19]

Hahn et al.

[11] 4,121,398

[45] Oct. 24, 1978

[54] SPACE FRAMEWORK

[75] Inventors: Volker Hahn, Leinfelden; Werner Fastenau, Esslingen-Rüdern, both of Fed. Rep. of Germany

[73] Assignee: Ed. Züblin Aktiengesellschaft, Stuttgart, Fed. Rep. of Germany

[21] Appl. No.: 682,627

[22] Filed: May 3, 1976

[30] Foreign Application Priority Data

May 2, 1975 [DE] Fed. Rep. of Germany ..... 2519664

[51] Int. Cl.[2] ..... E04C 3/02

[52] U.S. Cl. ..... 52/646; 52/600; 52/648

[58] Field of Search ..... 52/646, 648, 600, 602, 52/250, DIG. 10, 641

[56] References Cited

U.S. PATENT DOCUMENTS

| | | | |
|---|---|---|---|
| 2,140,283 | 12/1938 | Faber | 52/648 |
| 2,803,317 | 8/1957 | Henderson | 52/641 |
| 3,364,633 | 1/1968 | Polo | 52/648 |
| 3,705,473 | 12/1972 | Yeffal-Rueda | 52/648 |
| 3,722,160 | 3/1973 | Bentley | 52/583 |
| 3,731,450 | 5/1973 | Du Chateau | 52/648 |
| 3,789,562 | 2/1974 | DeChicchis | 52/648 |
| 3,800,490 | 4/1974 | Conte | 52/250 |

FOREIGN PATENT DOCUMENTS

| | | | |
|---|---|---|---|
| 648,462 | 9/1962 | Canada | 52/648 |
| 1,280,634 | 11/1961 | France | 52/648 |
| 964,159 | 8/1950 | France | 52/648 |

*Primary Examiner*—Ernest R. Purser
*Assistant Examiner*—Henry Raduazo
*Attorney, Agent, or Firm*—Walter Becker

[57] ABSTRACT

A space framework for building up dismountable ceilings and walls which comprises pyramid-shaped elements each including reinforced concrete slabs with corners connected to steel profiles which are adapted to be subjected to tensile and pressure forces and come together at a joint. The pyramid-shaped elements are at the corners of the pertaining reinforced concrete slabs put together by means of connecting elements to form a space confining surface adapted in its plane to take up pressure forces. The joints at the tips of the respective pyramids are connected to tension members extending substantially parallel to the reinforced concrete slabs.

13 Claims, 7 Drawing Figures

SPACE FRAMEWORK

The present invention relates to a three-dimensional framework for making dismountable ceilings and walls. Three-dimensional frameworks find an ever-increasing application not only because they are able with only a small expenditure of materials to span large surfaces in a statically very favorable manner free of supports but also offer the artchitect various attractive design possibilities.

Quite a number of systems have become known for the construction of three-dimensional frameworks or. All of these systems have in common that they consist of chord and diagonal struts which are interconnected at joints either directly or by means of special connecting elements. These three-dimensional frameworks do not have a space-defining function but serve as supporting constructions for space-defining plates. The impression of elegance and light weight of a three-dimensional framework is greatly influenced by the slenderness of its frame members. With the tension chords, it is possible to take up great forces by means of slender profiles. Inasmuch as the forces in the diagonal struts in comparison to those of the chords are always small, slender constructions are possible with diagonal struts even when subjected to pressure.

With pressure chords due to the danger of buckling, awkward and uneconomical cross sectional shapes cannot be avoided. Most of the three-dimensional frameworks serve in the form of ceilings and walls to define a space which however they cannot directly produce but only by aiding space defining plates. To this end, for instance, at the joints of the chords on the pressure side, small studs at the joints serve as support for purlins upon which plates for instance as corrugated steel sheets are mounted. Since this type of space confinement aesthetically is not very satisfactory, frequently the architect will demand additional ceiling panels to be hung underneath said purlins.

It is an object of the present invention to overcome the above mentioned drawbacks of heretofore known space frame structures or three-dimensional frameworks, namely the poor capability of the pressure chords to absorb pressures and the unsatisfactory space confinement on the pressure chord side.

These and other objects and advantages of the invention will appear more clearly from the following specification in connection with the accompanying drawings, in which.

Figure 1:
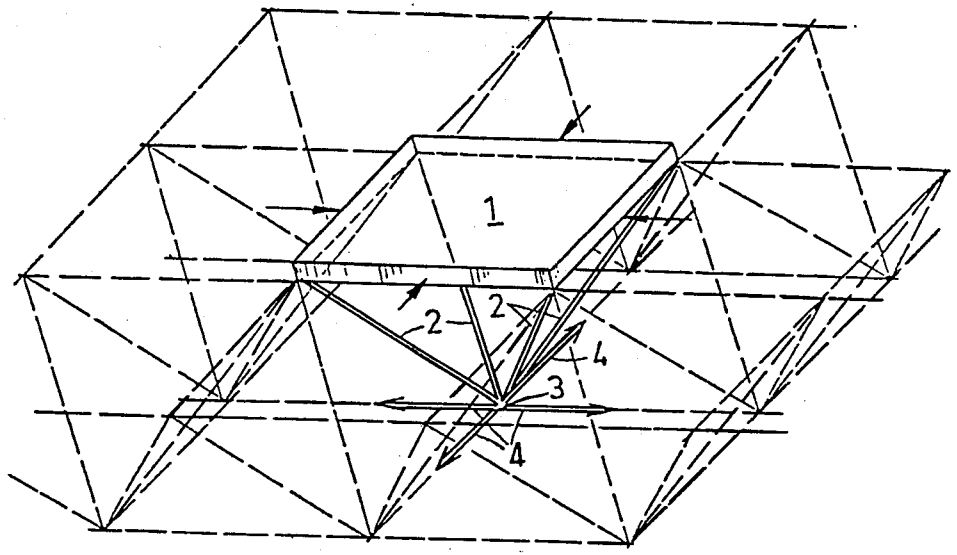
FIG. 1 illustrates an isometric view of a cutout of a three-dimensional or space framework.

The space framework for the construction of dismountable ceilings and walls according to the present invention is characterized primarily in that it comprises pyramid-shaped elements each including a reinforced concrete slab the corners of which are connected to steel profiles or steel tubes which are adapted to be subjected to tension and pressure and meet in a joint at the tip of the pyramid are by said pyramid-shaped elements help of connecting elements at the corners of the reinforced concrete slabs composed to a space-defining surface which in its plane is suitable for absorbing pressure forces, whereas the joints at the tips of the pyramids are connected to tension chords extending parallel to the space-defining surface.

The space framework according to the invention thus in its pressure chord plane consists of reinforced concrete slabs which are able to take up high pressure forces while simultaneously performing a space-confining function.

The capability of reinforced concrete slabs to endure high pressure forces enables the construction of post-tensioned space frameworks characterized by polygonal tendons extending within the framework and and anchored in the reinforced concrete slabs of the pyramid-shaped elements at the edges, said tendons conveying the transverse forces activated in the break points of the tendon to the joints of the tension chord, thus counteracting to the load.

According to the invention, the reinforced concrete slabs of the pyramidal elements may be designed so as to be triangular or rectangular in plan view.

The most expedient shape of the reinforced concrete slab is the trough slab (Kassetten Platte), a light-weight slab consisting of a very thin concrete slab with a thicker reinforced frame-shaped edge. As the dead weight of the space framework is of decisive importance when large spans are involved, it is advantageous according to the invention to use light weight concrete as material for the slabs.

These slabs are also well suited for the installation of domelights and vents. When a heat insulation is required, the slabs can in a manner known per se be designed with a plurality of layers.

With space frameworks it is important that the axes of gravity of the chords and braces are congruent with the system lines in order to avoid bending moments which cannot be absorbed by slender chords or struts. When space frameworks are to be supported by walls the bearing joints of the framework have to be placed in the wall plane which with visible frameworks represents an aesthetically unsatisfactory solution.

With the space framework according to the invention, it is expedient to design the reinforced concrete slabs on the bearing in a way that the outermost framework system point is located on the inside of the support wall, and the bearing force is conveyed by the cantilevering reinforced concrete slab which is particularly dimensioned to take up the bending moment. With post-tensioned frameworks, the cantilevering edge slab is so thickened and reinforced that it will also be able to take up the vertical component caused by the anchoring of the tendon.

An important requirement for a space framework consists in that the lengths of the chords and struts very precisely correspond to the theoretical lengths derived from the geometry of the system. The required precision in concrete construction cannot be realized even with prefabricated concrete parts. Therefore, the procedure with the framework according to the invention is such that not the insufficiently precise reinforced concrete slabs abut each other at the gaps but that in the corners of the reinforced concrete slabs, steel pegs are set in concrete for the connection to the connecting element which is a steel plate with corresponding recesses to take up the pegs. A precise fit of the steel with an accuracy common for steel structures but due to its material properties maintainable for concrete structures; can be achieved by means of templates mounted in the formwork for the reinforced concrete slabs which receive the pegs during the setting of the concrete.

Referring now to the drawings in detail, FIG. 1 represents an isometric view of a cutout of a space framework according to the invention. For purposes of a clearer illustration, a pyramid-shaped element has been emphasized, whereas otherwise only the system lines have been shown and these have been illustrated only by dash lines. The reinforced concrete slab 1 is as indicated by the arrows, able to take up pressure forces in its plane in any direction. At the corners of the reinforced concrete slab 1 which is illustrated as being square-shaped but which may also be triangular or rectangular in plan, steel profiles 2 are connected which meet at the joint 3 in a pyramid-shaped form. The tension chords 4 meet at the joint 3 in a manner parallel to the reinforced concrete slab.

Figure 2:
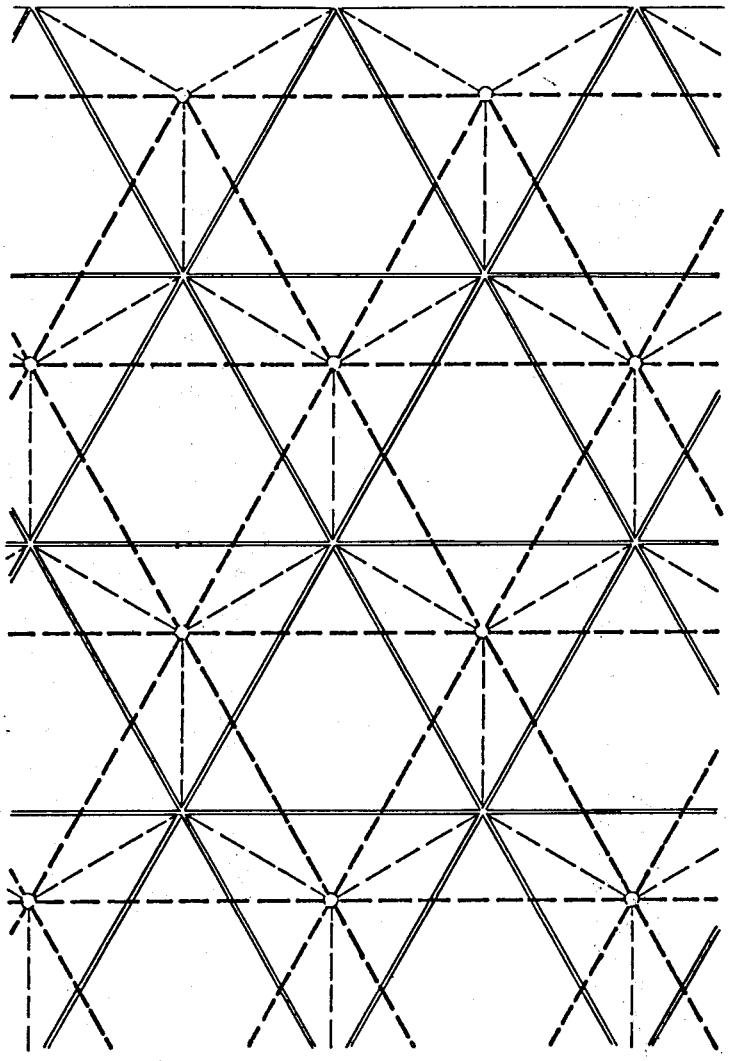
FIG. 2 represents a plan view of a triangular space framework.
Figure 3:
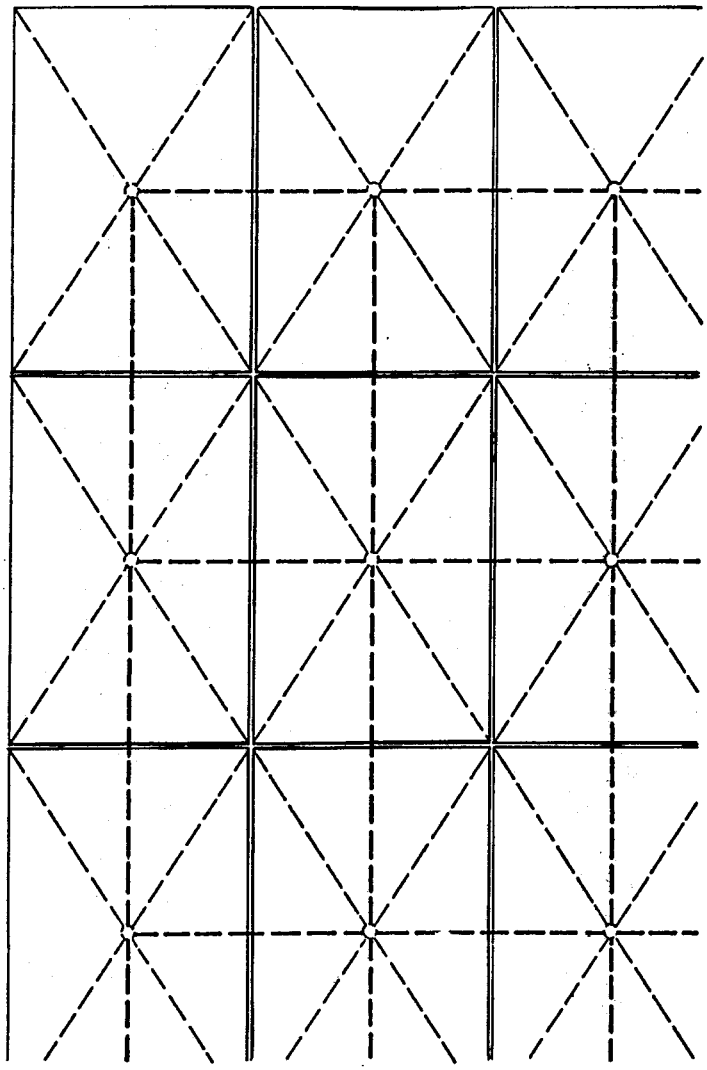
FIG. 3 represents a plan view of a rectangular space framework.

FIGS. 2 and 3 show a framework consisting of pyramid-shaped elements with triangular respectively rectangular reinforced concrete slabs.

Figure 4:
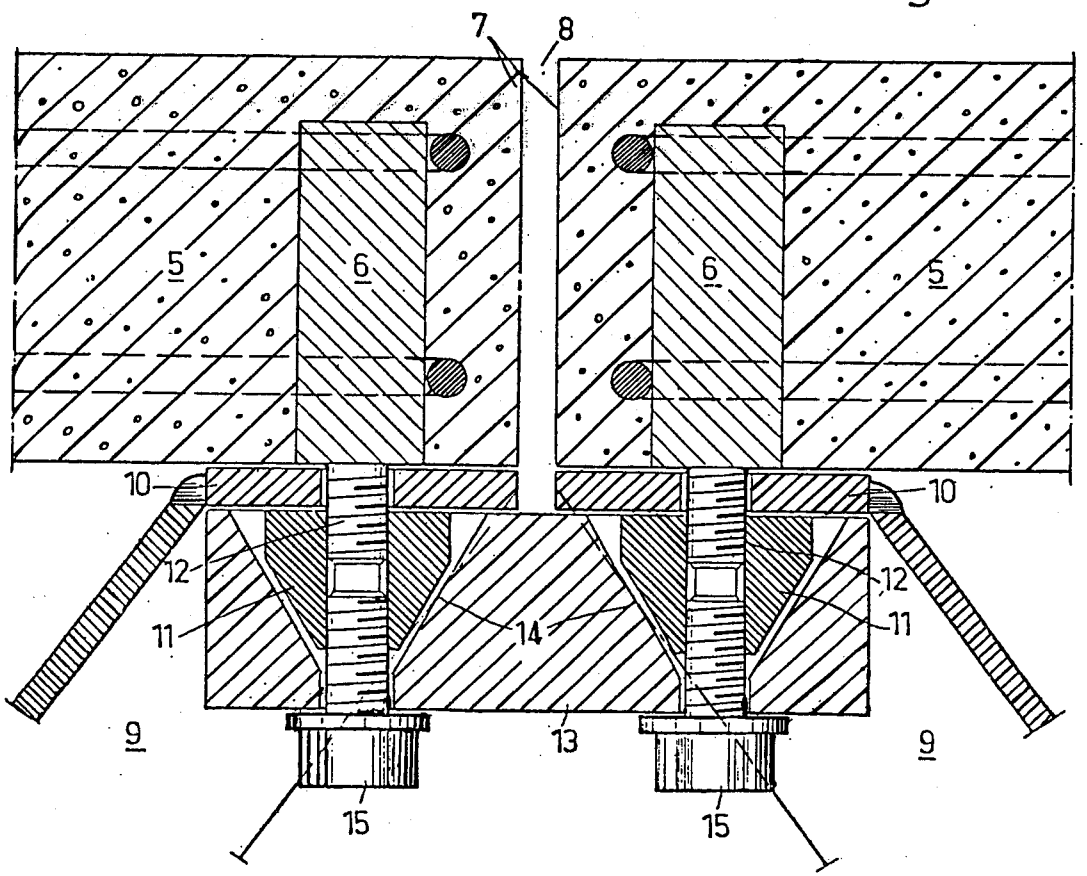
FIG. 4 represents a section through a space-framework at the corner point of two reinforced concrete slabs with the connection of diagonal struts being steel profiles.

FIG. 4 shows a section through the corner points of two reinforced concrete slabs 5. By means of a template connected to the formwork, the steel pegs 6 have been set into the reinforced concrete slab very precisely to measurement. Unfavorable inaccuracies in the edge of the slab 7 will thus exert no influence because the slabs do not abut each other at their edges. However, it may be expedient to fill gaps 8 with mortar after mounting the framework so that it will not be necessary to transfer the chord forces occurring at maximum load through said connecting construction. The diagonal strut 9, in the specific example shown a steel angle, has at its ends a perforated plate 10 by means of which it is by the nut 11 and the end of the threaded bolt 12 of peg 6 connected to the slab 5. The connecting element between the slabs 5 is formed by the square shaped steel plate 13 to which thus four reinforced concrete slabs can be interconnected at their corner points. To this end, the steel plate 13 has four cone-shaped widening bores 14 into which the conical nuts 11 fit. The connection is effected by the bolt 15.

The illustrated connection between the pyramid-shaped elements at the corners of the steel concrete plates is merely an example.

Figure 5:
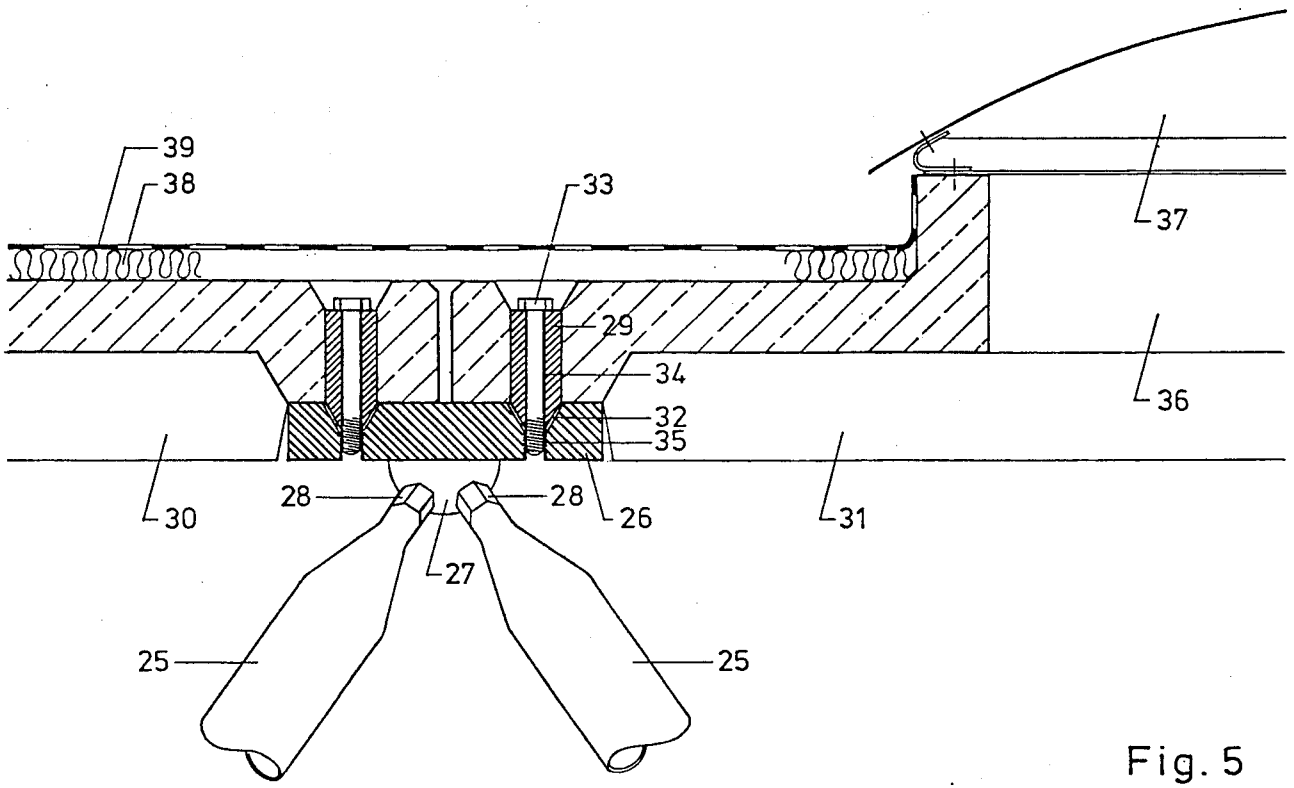
FIG. 5 represents a section through a space framework the diagonal struts of which are steel tubes with pertaining construction of the connection at the corners of the reinforced concrete slab. The concrete slabs are trough slabs, one of which has a recess on which a domelight is mounted.

FIG. 5 represents a section through a space framework the diagonal struts 25 of which are steel tubes. The pertaining connection element again is a steel plate 26, which on its bottom side has a hemisphere 27 for a screw connection 28 of the struts 25. The pegs 29 of the reinforced concrete slabs 30, 31 fit with their extruding tips into the relating recesses 32 in the steel plate 26. The connection is held together by bolts 33 passing through a boring 34 in the peg and scrwed into a thread 35 in the steel plate 26. The fundamental idea according to the invention is not to permit the reinforced concrete slabs to abut each other directly because the precision obtainable in this way is not sufficient. The connection should rather be effected by a connecting element which engages pegs that have been precisely set in concrete by means of gauges at the corners of the reinforced concrete slabs thus attaining an accuracy only common with steel structures.

FIG. 5 shows furthermore a reinforced concrete slab 31 that has a recess 36 that is covered with a domelight 37. On the reinforced concrete slabs 30, 31 is fixed an insulation layer 38 which is topped by a roofing skin 39.

Figure 7:
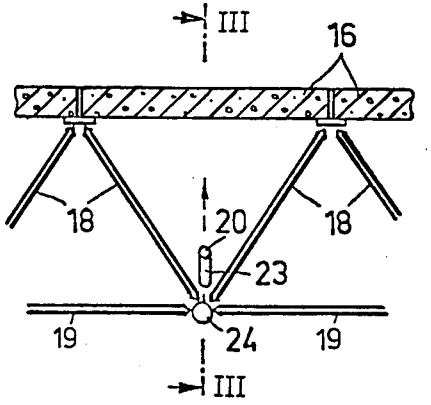
FIG. 7 is a section taken along the line IV—IV of FIG. 6.
Figure 6:
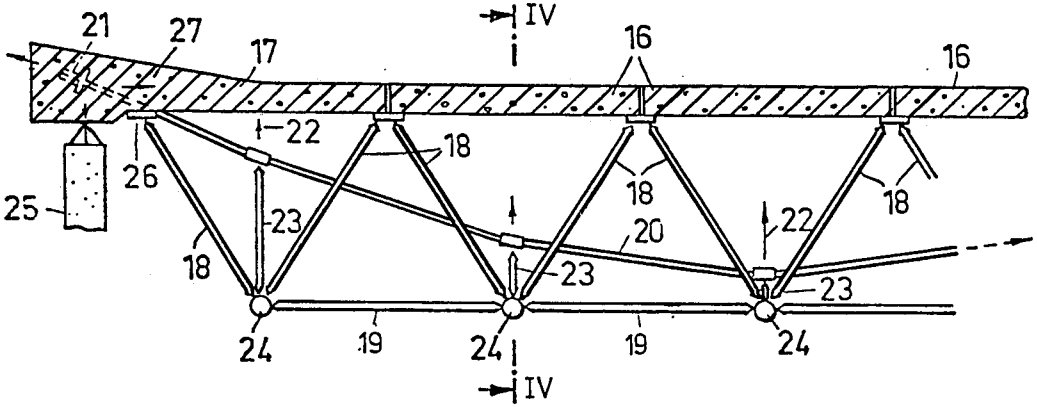
FIG. 6 is a section through a space framework with a post-tensioning tendon, said section being taken along the line III—III of FIG. 7.

FIGS. 6 and 7 illustrate sections through a past-tensioned framework (unterspanntes Fachwerk) which comprises reinforced concrete slabs 16 and 17 in the pressure chord plane, diagonal struts 18, and tension chords 19. The framework comprises a tendon 20 consisting of stressing wires displaceably arranged in a pipe, said wires when being tensioned are anchored in an end anchors 21 which are cast in the reinforced concrete slab 17. The tendon is of a polygonal shape with breaking points over the tension chord joints. The transverse forces 22 acting at the break points when the tendon has been stressed are conveyed to the chord joints 24 by pulling members 23. The tendon 20 is guided in a parabolic manner so that at each polygonal point there will act the same upwardly directed transverse force 22. The pulling members 23 are by means of connecting screws connected to the tension chord jonts. When the tendon extends in a flat manner it is difficult from the start so to adjust the length of the pulling members 23 that in each tension chord joint a transverse force 22 of the same force will be furnished. According to the invention, the adjustment of transverse forces to have all the same magnitude is effected by tightening or loosening by turnbuckle action the connecting screws of the pulling members 23 by means of a torque wrench.

FIG. 6 also shows a section through a bearing for the space framework on a wall 25 if for reasons of architecture it is desired that the marginal joint 26 by which the diagonals 18 are connected to the edge slab 17 is located with a distance to and on the inside of the wall 25. The slab 17 is by reinforcement or thickening 27 and/or corresponding steel reinforcement so designed that the plate slab can convey the bearing force by bending. With a post-tensioned framework, the reinforcement area 27 may expediently be taken advantage of for taking up the vertical components of the anchor 21 of the tendon 20, and to mount the anchor 21 in said marginal reinforced or thickened portion.

It is, of course, to be understood that the present invention is, by no means, limited to the showing in the drawings, but also comprises any modifications within the scope of the appended claims.

What we claim is:

1. A space framework for building up dismountable ceilings and walls, which includes: pyramid-shaped elements, each of said elements including a reinforced concrete slab with side edges and corners, steel profiles or tubes connected to said corners and adapted to be subjected to tensile and pressure forces, and a joint; the profiles of each of said pyramid-shaped elements coming together at the respective pertaining joint; connecting elements connect said pyramid-shaped elements at the corners of the pertaining reinforced concrete slabs free of side edge connections to form a space-confining surface adapted in its plane to receive pressure forces; and tension members extending substantially parallel to said space confining surfaces; said joints being respectively located at the tips of said pyramid and being connected to said tension members, said connecting elements being located transverse to the plane of the slabs and including pegs set into the reinforced concrete slab very precisely to measurement, said pegs having ends projecting freely underneath the slabs, a strut having a perforated plate portion including openings through which the ends of the pegs extend, said ends defining a connecton, conical centering members secured to the connection of the ends, and a connection plate having cone-shaped bores into which said conical centering members fit which cover the corners of adjoining slabs to hold said connection plate therewith.

2. A space framework for building up dismountable ceilings and walls, which includes: pyramid-shaped elements, each of said elements including a reinforced concrete slab with side edges and corners, steel profiles or tubes connected to said corners and adapted to be subjected to tensile and pressure forces, and a joint; the profiles of each of said pyramid-shaped elements coming together at the respective pertaining joint; connecting elements connect said pyramid-shaped elements at the corners of the pertaining reinforced concrete slabs free of side edge connections to form a space-confining surface adapted in its plane to receive pressure forces; and tension members extending substantially parallel to said space confining surfaces; said joints being respectively located at the tips of said pyramid and being connected to said tension members, post-tensioning tendons anchored in said reinforced concrete slabs at the edge of said framework, and pull members arranged between the tips of said pyramid-shaped elements and the post-tensioning tendon, said post-tensioning tendons extending between the surface formed by said reinforced concrete slabs and said joints at said pyramid tips so as to define a polygon and being operable to convey transverse tensile forces acting at the corners of said polygon via said pull members to said joints.

3. A framework according to claim 1, in which said reinforced concrete slabs are rectangular in plan view.

4. A framework according to claim 2, in which said reinforced concrete slabs are triangular in plan view.

5. A framework according to claim 2, in which said reinforced concrete plates are designed as a trough slab formed as a very thin slab with a thicker, reinforced frame-shaped edge.

6. A framework according to claim 2, in which said reinforced concrete slabs are of light concrete.

7. A framework according to claim 2, in which said reinforced concrete slabs at the edge of said space framework project beyond said space framework, said projection being statically so dimensioned so as to be able to serve as bearing for said framework.

8. A framework according to claim 2, in which said reinforced concrete slabs are provided with recesses for installation of domelights, vents and the like.

9. A framework according to claim 2, in which said reinforced concrete slabs have a plurality of layers for insulation purposes.

10. A framework according to claim 2, in which said reinforced concrete slabs have each of their corners provided with steel pegs for a precise mechanical connection with a connecting element.

11. A framework according to claim 2, which includes connecting screws in turnbuckle fashion at the ends of the pull members, and in which with post-tensioned frameworks said pulls members are connected by means of said connecting screws, said connecting screws being operable for instance by a torque wrench to adjust all of the tensile forces acting in said pull members to the same value.

12. A framework according to claim 2, wherein between said connecting elements and an underside of said slabs there is a plate with bores to permit fastening on diagonal struts.

13. A framework according to claim 10, wherein said connecting elements have conically-formed bores, and bolts with conical nuts that fit into said bores to maintain connection therewith.

* * * * *